United States Patent [19]

Perry

[11] Patent Number: 4,846,384

[45] Date of Patent: Jul. 11, 1989

[54] HOLSTER FOR AUTOMATIC PISTOL

[75] Inventor: Wilbert O. Perry, Bunnlevel, N.C.

[73] Assignee: Gould & Goodrich Leather, Inc., Lillington, N.C.

[21] Appl. No.: 223,979

[22] Filed: Jul. 25, 1988

[51] Int. Cl.[4] ..... F41C 33/04; F41C 33/02

[52] U.S. Cl. ..... 224/244; 224/911; 224/193

[58] Field of Search ..... 224/911, 912, 913, 242, 224/243, 244, 191, 192, 193, 230

[56] References Cited

U.S. PATENT DOCUMENTS

| | | | |
|---|---|---|---|
| 468,556 | 2/1892 | Anderson | 224/244 X |
| 1,110,993 | 9/1914 | Sisson | 224/911 X |
| 1,851,352 | 3/1932 | Denkert | 224/911 X |
| 1,951,865 | 3/1934 | Franz | 224/911 X |
| 2,434,380 | 1/1948 | Williams | 224/911 X |
| 3,866,811 | 2/1975 | Hamby | 224/911 X |
| 3,910,469 | 10/1975 | Baldocchi | 224/244 X |

*Primary Examiner*—Henry J. Recla
*Assistant Examiner*—Daniel Stein-Freer
*Attorney, Agent, or Firm*—Wheeler Law Firm

[57] ABSTRACT

A flexible top opening holster for semi-automatic and other pistols which prevents or inhibits the unauthorized removal of the pistol from the holster by means of a restraining device contained within the holster.

7 Claims, 3 Drawing Sheets

HOLSTER FOR AUTOMATIC PISTOL

BACKGROUND OF THE INVENTION

There is a recognized need for holsters that have a device which prevents the unauthorized removal of an automatic pistol or a revolver by someone other than the wearer. This need has inspired a variety of different inventions that provide for restraint of revolvers or automatic pistols within a holster. The present invention is designed to better restrain automatic or semiautomatic pistols against removal by others, within a holster that has flexible side walls; while permitting a natural draw. The device of the invention restrains the pistol within the holster from the inside of the trigger guard and allows removal of the pistol from the holster only by the wearer through the top opening of the holster. A number of holsters are known, many of which include restraining devices of other kinds which prevent the removal of the pistol from the holster but do not engage inside the trigger guard. See, for example, U.S. Pat. No. 3,420,420 (E. J. Clark), U.S. Pat. No. 1,113,530 (F. H. Audley), U.S. Pat. No. 4,256,243 (Bianchi et al), U.S. Pat. No. 4,277,007 (Bianchi et al), U.S. Pat. No. 1,320,751 (Freyer), U.S. Pat. No. 1,844,603 (Sarson), U.S. Pat. No. 2,001,321 (Berns), U.S. Pat. No. 2,577,869 (Adams) and U.S. Pat. No. 3,942,692 (Chica). Many of these prior art holsters use restraints which engage either the outside of the trigger guard or the butt of the pistol to prevent removal through the top opening of the holster. Some of these prior art holsters use springs to either maintain the pistol in position within the holster or to keep the pistol engaged with the restraining device. Only two of these prior art holsters are known to have a restraining device which engages the inside of the trigger guard. U.S. Pat. No. 1,113,530 (F. H. Audley), uses a restraining device, called H3, that enters the trigger guard to hold the pistol within the holster, but requires that the restraining device be released by first physically pulling the restraint out of the trigger guard and then drawing the pistol. U.S. Pat. No. 4,277,007 (Bianchi et al), has a device which enters the trigger guard to prevent the pistol from being drawn out through the top opening of the holster but in order for the invention to work the pistol must be drawn forward through an opening in the front wall of the holster, U.S. Pat. No. 3,942,692 (Chica), uses a holster which restrains the gun by means of a nylon welt which engages the back of the trigger guard, between the gun handle and the trigger, and is maintained in that position by means of a spring in the front wall of the holster. This holster requires that the pistol used have a trigger guard which can engage the nylon welt in the above described manner while the present invention merely requires that the inside of the trigger be engaged and therefore an automatic pistol having the rear portion of its trigger guard as an integral part of the handle of the gun can be used with the present invention whereas the prior art device could not be used. In addition the present restraint is more secure. Finally, all prior art devices known to the inventor make modifications to the outside as well as the inside of the holster, while the modifications we make to the holster are all contained inside of the holster. Therefore, there is nothing about the outward appearance of the holster which would indicate its true nature and function to a potential adversary.

SUMMARY OF THE INVENTION

We have developed and invented a mechanism that works for holsters with a top opening, allowing the easy insertion of a pistol, effective holding of the pistol in the holster, resistance to withdrawal of the pistol from the holster through the top opening in a backward or upward motion and allowing natural removal of the pistol through the top of the holster in a forward drawing motion.

The invention comprises a top opening holster for use with automatic pistols having a body including side walls, a front wall and a rear edge. The side walls join to form a pouch having a top opening for easy insertion of the pistol into the holster. The mechanism for restraining the pistol in the holster is a wedge with a thick side, a thin side, a thick end and a thin end. This allows the trigger guard of the pistol to move from the thin end of the wedge as the gun is placed in the holster until the trigger guard passes the thick end of the wedge and drops over the edge of the wedge. During the draw the gun is pushed forward, causing the trigger guard to ride up the thin side of the wedge and over the thick side of the wedge, allowing the gun to be drawn forward and upward out of the holster. The forward motion of the gun against the spring raises the trigger guard with respect to the wedge until it clears the thick side and thick end of the wedge and allows upward motion of the gun. The side walls of the holster contain two leaf springs which center the gun and allow the holster to flex to provide for easy placement of the pistol within the holster and easy withdrawal of the pistol from the holster allowing the pistol to rotate slightly to allow the trigger guard to ride up the tapered side of the wedge. For pistols having a visible ejection port a third spring is added to the front wall of the holster, which in conjunction with a wider holster, will maintain the ability of the springs to hold the pistol in the center of the holster and keep firm engagement of the trigger guard with the wedge, while at the same time allowing the pistol to be easily withdrawn.

These and other benefits of the present invention will be obvious to one skilled in the art from the drawings and detailed description which follow.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. While the preferred embodiment has been described the details may be changed without departing from the invention, which is defined by the claims.

The device of this invention includes a wedge 30 that works in conjunction with a holster 10, such that, when the pistol 50 is in the holster 10 it can not be withdrawn from the holster 10 by either pulling the pistol 50 up and out towards the rear of the holster 10 or straight up and out of the holster 10. The pistol 50 may only be withdrawn from the holster 10 by a person who is aware of the manner in which the device of the this invention works. However, the required motion is easy and natural for the wearer, and quite un-natural for a person wishing to take the pistol 50 from the wearer of my holster 10.

Figure 1:
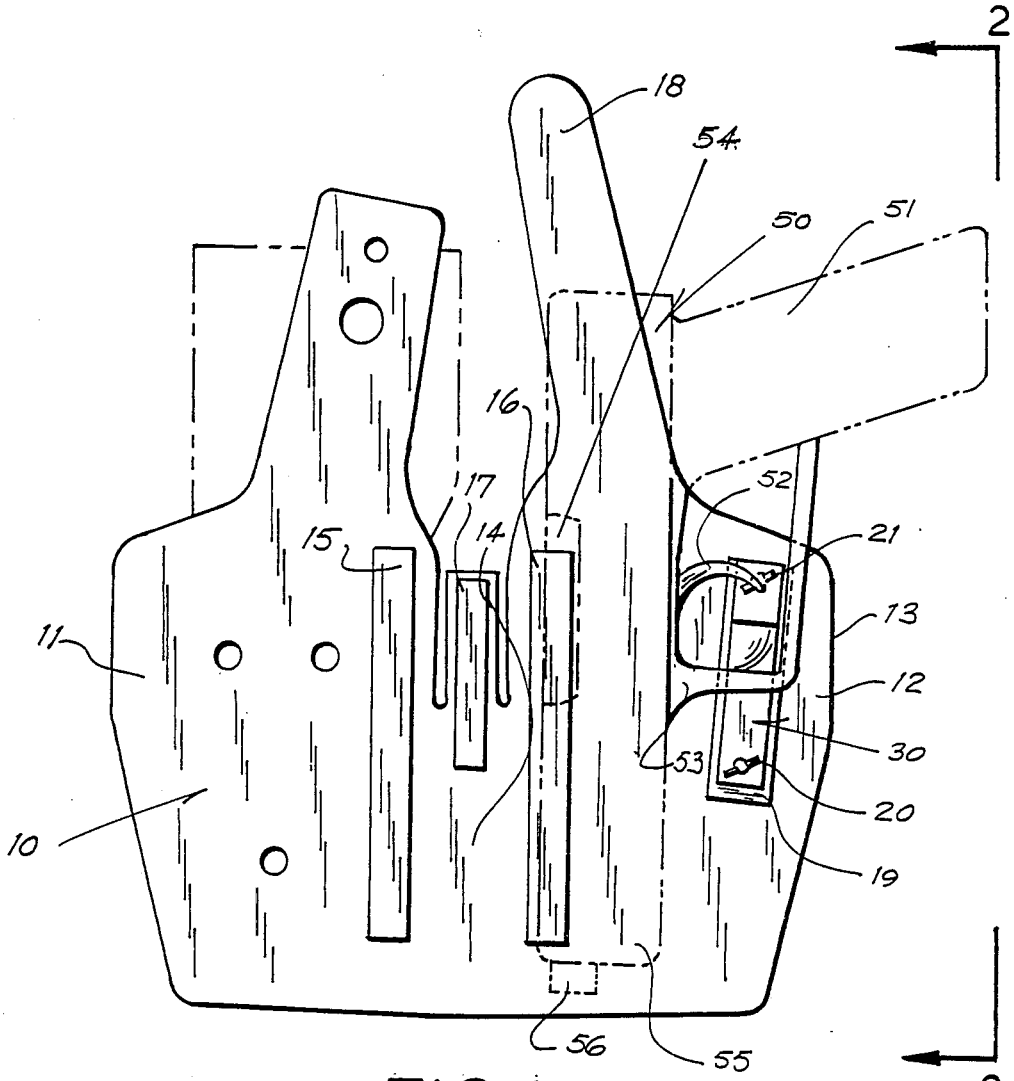
FIG. 1 is a top plan view of the holster blank with the pistol, shown in what would be its normal carrying position, superimposed over the blank.

FIG. 1 shows a top plan view of the holster blank with the pistol 50 superimposed over that view. The holster 10 is comprised of three walls; a left side wall 11, a right side wall 12, and a front wall 14. Attached and contained in each wall of the holster 10 is a leaf spring. The left side, right side and front wall springs are labeled 15, 16 and 17 respectively; see FIG. 1. The device of the invention, the wedge 30, is attached to the right side wall 12 of the holster 10. The wedge 30 rests upon a backplate 19 and both the wedge 30 and the backplate 19 are attached to the right side wall 12 by means of two fasteners labeled 20 and 21 respectively. The right and left directions given in this description are for a right handed holster. If a left handed holster were described the directions, right and left, would be reversed.

Again referring to FIG. 1 the pistol 50 is comprised of a handle 51, a trigger 52, a trigger guard 53, and a pistol barrel 55, along with a pistol muzzle 56.

Figure 6:
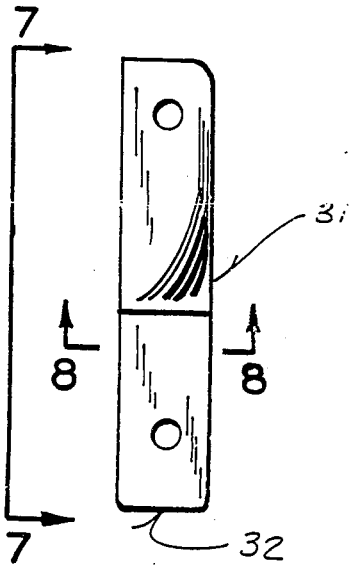
FIG. 6 is a top plan view of the restraining wedge.
Figure 7:
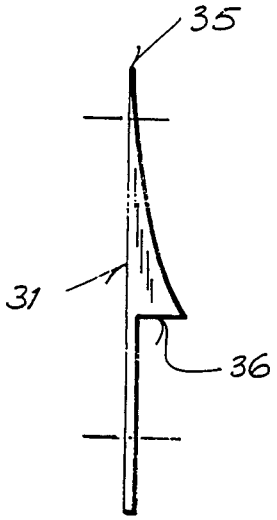
FIG. 7 is the view from line 7—7 of FIG. 6.
Figure 8:
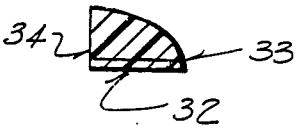
FIG. 8 is the view from line 8—8 of FIG. 6.

Referring to FIG. 6, one may see a top plan view of the wedge 30. The wedge 30 is comprised of a long axis 31, a short axis 32, a thin side 33, a thick side 34, a thin end 35 and a thick end 36. Referring to FIG. 7 which is a view from line 7—7 of FIG. 6 one may see the long axis 31 of the wedge 30, the thin end 35 of the wedge 30 and the thick end 36 of the wedge 30. FIG. 8 shows a view from line 8—8 of FIG. 6 and illustrates the short axis 32 of the wedge 30 with the thin side 33 and the thick side 34 of the wedge 30 also shown.

Figure 2:
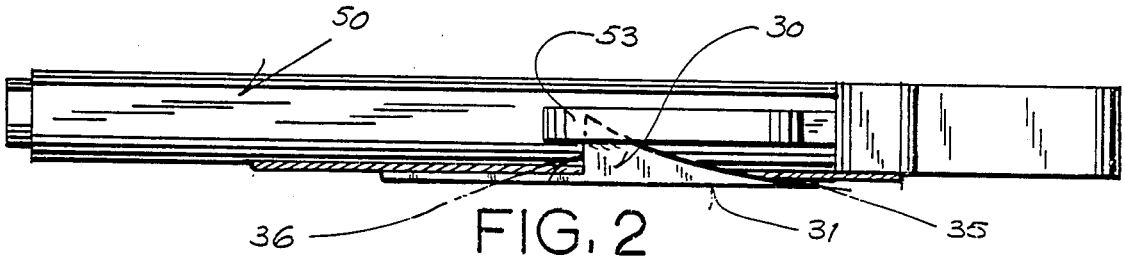
FIG. 2 is the view from line 2—2 of FIG. 1.
Figure 3:
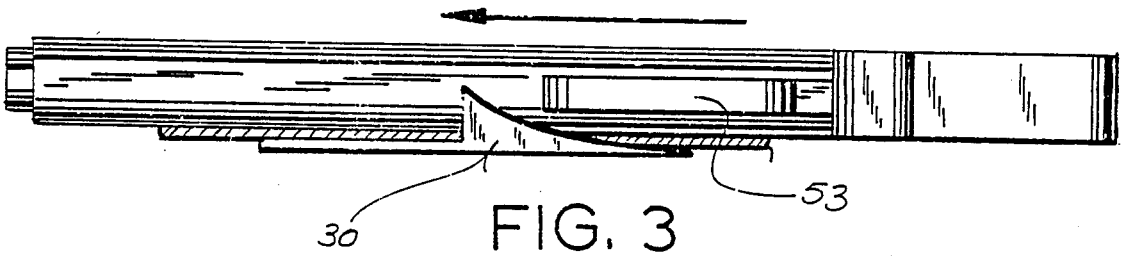
FIG. 3 is a rear elevational view of the pistol and the restraining wedge, showing how the pistol is placed on the wedge.
Figure 4:
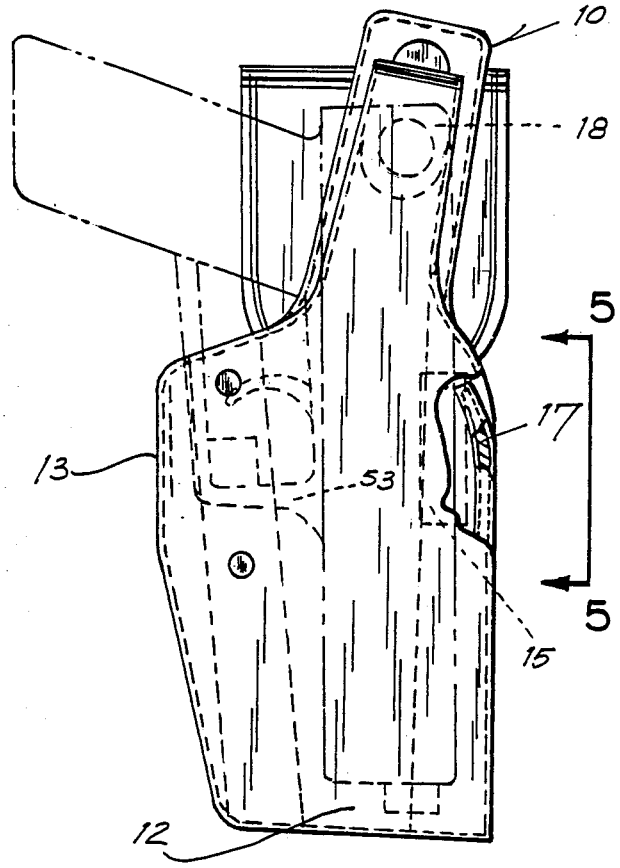
FIG. 4 is a side elevational view of the holster and pistol.

To see how the wedge 30 and the pistol 50 interact we now refer to FIG. 3 and FIG. 2. FIG. 3 is a rear elevational view of the pistol 50 and the wedge 30 showing the pistol being placed on the wedge 30. FIG. 2 is a view from line 2—2 of the FIG. 1 showing the pistol 50 with its trigger guard 53 over the thick end 36 of the wedge 30. These two drawings illustrate the motion of the pistol 50 as it is placed in the holster 10. The trigger guard 53 of the pistol 50 moves along the long axis 31 of the wedge 30 from the thin end 35 of the wedge 30 up and over the thick end 38 of the wedge 30, such that, the trigger guard 53 goes over the thick end 36 of the wedge 30 and is thereby restrained in the holster 10.

Figure 9:
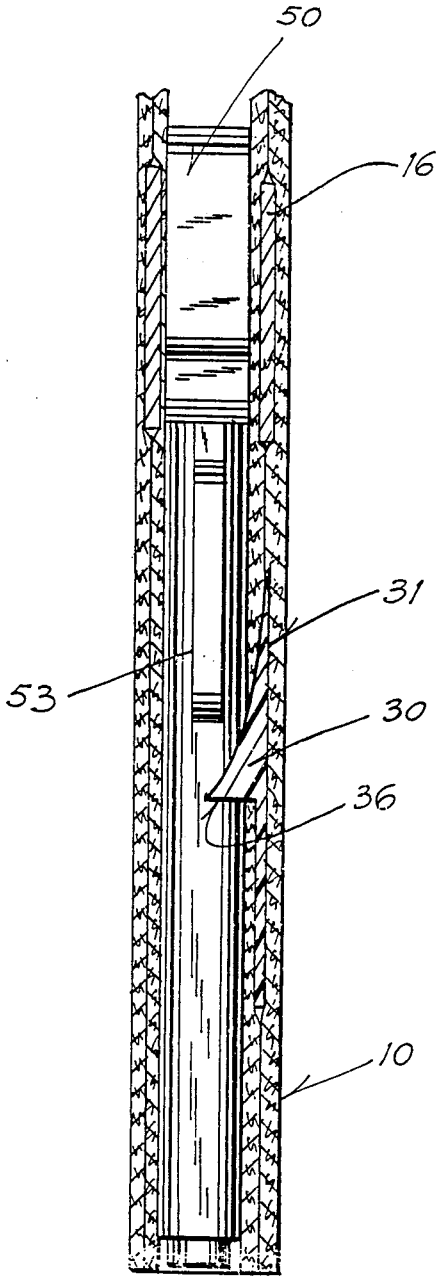
FIG. 9 is a rear elevational view showing the relationship of the holster and the pistol.

The interaction of the holster 10 with the pistol 50, as the pistol 50 is being placed into the holster 10 or being removed from the holster 10, is illustrated in FIG. 9. As the pistol 50 is inserted into the holster 10 and begins to move along the long axis 31 of the wedge 30 the right side wall spring 16 flexes allowing the trigger guard 53 of the pistol 50 to pass over the thick end 36 of the wedge 30. As the pistol 50 is withdrawn from the holster 10 the right side spring 16 flexes again allowing the trigger guard 53 of the pistol 50 to pass over the thick side 34 of the wedge 30.

Figure 5:
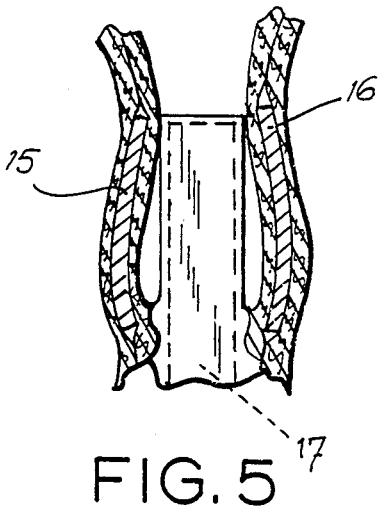
FIG. 5 is the view from line 5—5 of FIG. 4.

The wedge 30 is able to prevent the withdrawal of the pistol 50 from the holster 10 is either an upward or a backward direction by virtue of its thick side 34 and its thick end 36 which engage the trigger guard 53 when the pistol 50 is in the normal carrying position within the holster 10. The left side wall spring 15 and the right side wall spring 16 maintain pressure on the pistol 50 as illustrated in FIG. 5, and keep the trigger guard 53 in firm engagement with the thick side 34 and the thick end 36 of the wedge 30. If the pistol 50 is equipped with a visible ammunition ejection port 54 then a holster like the holster 10 illustrated in FIG. 1 having a front wall spring is required. Since this will allow for a wider holster which can accommodate a pistol 50 having a visable ammunition ejection port 54 and not run the risk of having the ammunition ejection port 54 come into contact with the wedge 30 during the drawing motion while still maintaining sufficient pressure on the pistol 50 to keep it in firm engagement with the wedge 30 and the thick side 34 and the thick end 36.

The pistol 50 may be withdrawn from the holster 10 by having the wearer first rotate the pistol 50, whereby the trigger guard 53 will ride up and over the short axis 32 of the wedge 30, and second, drawing the pistol 50 upward and forward out of the holster 10.

The above described embodiments of this invention are merely descriptive of its principles and are not to be limiting. The scope of this invention instead shall be determined from the scope of the following claims, including their equivalents.

What is claimed is:

1. In a holster, comprising two side walls, a front wall, and a rear edge where the two side walls are joined to form a pouch, said pouch having an opening at its top to allow for placement of an automatic or semi-automatic pistol in the holster:

The improvement comprising: a wedge secured to one of said side walls inside of the holster, said wedge having a thick end, a thin end, a thick side and a thin side, said wedge also having a long axis generally parallel with the front of the holster and a short axis generally at right angles to the long axis and parallel to the surface of the side of the holster, said wedge being tapered from thin to thick along each said axis, the taper along the long axis being oriented in the holster such that the thin end of the wedge is generally oriented toward the top opening of the pouch and the thick end of the long axis of the wedge is nearest to and generally oriented towards the bottom of the holster, while the taper along the short axis has its thin side generally oriented towards the rear edge of the holster and the thick side along the short axis is generally oriented towards the front wall of the holster;

Said wedge being positioned in said holster so that as the pistol is inserted into the holster, the portion of the trigger guard of the pistol located between the trigger and the pistol muzzle, extending along an axis that is generally perpendicular to the barrel of the pistol and generally parallel with the trigger of the pistol, will move from the thin end to the thick end of the wedge along the taper of the long axis until the thick end of the wedge enters the space between the trigger guard and the trigger; whereby the pistol upon being oriented with respect to the wedge inserted into the holster will be such that the pistol barrel is generally parallel to the long axis of the wedge and the trigger guard is generally parallel to the short axis of the wedge; and the trigger guard of the pistol is positioned with the thick end of the wedge entering the space between the trigger guard and the trigger of the pistol and thereby the pistol is prevented from being removed from the holster and further said wearer is able to remove the pistol from the holster by drawing the pistol forward and then upward, so that the trigger guard moves from the thin side to the thick side of the short axis of the wedge over the wedge and out of the holster.

2. The device of claim 1 in which the wedge is rigid.

3. The device of claim 1 in which the holster is further provided with at least one spring to maintain the position of the gun in the center of the holster with the trigger guard engaging the thick end of the wedge.

4. The device of claim 1 in which the holster is provided with a spring in its front wall, said front wall comprising a plane that is generally perpendicular to the side walls of the holster, while said spring extends along an axis that is generally parallel to the side walls of the holster, and generally upward and outward from its connection with the rest of the holster, allowing enough space for the insertion of an automatic pistol with a visible ammunition ejection port into the holster.

5. The device of claim 1 in which the holster is provided with a pair of springs, one in each side wall of the whereby when, the pistol has been inserted in the holster, and the top of the pistol barrel is nearest to the front wall of the holster and the sides of the pistol are parallel to the side walls of the holster, the pressure of said springs maintains the position of the pistol generally in the center of the holster.

6. The device of claim 1 in which the wedge has at least four sides, three sides being smooth and flat of which one side is the bottom of the wedge while the fourth side is a compound curve which extends along both the long and the short axes of the wedge.

7. The device of claim 1 in which the wedge is rigid and the holster is provided with at least one spring to maintain the position of the gun in the center of the holster with the trigger guard engaging the thick end of the wedge, said wedge having at least four sides, three sides being smooth and flat of which one side is the bottom of the wedge and the fourth side is a compound curve extending along both the long and short axes of the wedge, and said holster allows enough space for the insertion of an automatic pistol with a visible ammunition ejection port into the holster, said ammunition ejection port being located on the barrel of the pistol and running parallel with the barrel of the pistol.

* * * * *